US007003454B2

(12) United States Patent
Rämö

(10) Patent No.: US 7,003,454 B2
(45) Date of Patent: Feb. 21, 2006

(54) METHOD AND SYSTEM FOR LINE SPECTRAL FREQUENCY VECTOR QUANTIZATION IN SPEECH CODEC

(75) Inventor: Anssi Rämö, Tampere (FI)

(73) Assignee: Nokia Corporation, Espoo (FI)

( * ) Notice: Subject to any disclaimer, the term of this patent is extended or adjusted under 35 U.S.C. 154(b) by 974 days.

(21) Appl. No.: 09/859,225

(22) Filed: May 16, 2001

(65) Prior Publication Data

US 2003/0014249 A1 Jan. 16, 2003

(51) Int. Cl.
*G10L 19/12* (2006.01)

(52) U.S. Cl. ..... 704/223; 704/222; 704/219; 704/230; 704/264

(58) Field of Classification Search ..... 704/222, 704/219, 230, 223, 220, 221, 200.1, 262, 704/264, 266
See application file for complete search history.

(56) References Cited

U.S. PATENT DOCUMENTS 5,651,026 A * 7/1997 Lin et al. ..... 375/240
5,675,701 A 10/1997 Kleijn et al. ..... 395/2.31
5,675,702 A * 10/1997 Gerson et al. ..... 704/223
5,704,001 A 12/1997 Gardner ..... 395/2.28
5,754,733 A * 5/1998 Gardner et al. ..... 704/219
5,822,723 A * 10/1998 Kim et al. ..... 704/222
5,826,224 A 10/1998 Gerson et al. ..... 704/222
6,122,608 A 9/2000 McCree ..... 704/219
6,141,640 A 10/2000 Moo ..... 704/222
6,148,283 A * 11/2000 Das ..... 704/222
6,275,796 B1 * 8/2001 Kim et al. ..... 704/230

OTHER PUBLICATIONS

3G TS 26.090 V3.1.0 (Dec. 1999) 3rd Generation Partnership Project (3GPP); Technical Specification Group Services and Systems Aspects; Mandatory Speech Codec speech processing functions AMR speech codec: Transcoding functions.

* cited by examiner

*Primary Examiner*—Vijay Chawan
(74) *Attorney, Agent, or Firm*—Ware, Fressola, Van Der Sluys & Adolphson LLP

(57) ABSTRACT

A method and system for quantizing LSF vectors in a speech coder, wherein predicted LSF values based on previously decoded output values are used to estimate spectral distortion, along with the residual codebook vectors and the LSF coefficients. The method comprises the steps of obtaining a plurality of quantized LSF coefficients from the respective predicted LSF values and the residual codebook vectors; rearranging the quantized LSF coefficients in the frequency domain in an orderly fashion; obtaining the spectral distortion from the rearranged quantized LSF coefficients and the respective LSF coefficients; and an optimal code vector is selected based on the spectral distortion.

20 Claims, 9 Drawing Sheets

METHOD AND SYSTEM FOR LINE SPECTRAL FREQUENCY VECTOR QUANTIZATION IN SPEECH CODEC

FIELD OF THE INVENTION

The present invention relates generally to coding of speech and audio signals and, in particular, to quantization of linear prediction coefficients in line spectral frequency domain.

BACKGROUND OF THE INVENTION

Speech and audio coding algorithms have a wide variety of applications in communication, multimedia and storage systems. The development of the coding algorithms is driven by the need to save transmission and storage capacity while maintaining the high quality of the synthesized signal. The complexity of the coder is limited by the processing power of the application platform. In some applications, e.g. voice storage, the encoder may be highly complex, while the decoder should be as simple as possible.

In a typical speech coder, the input speech signal is processed in segments, which are called frames. Usually the frame length is 10–30 ms, and a look-ahead segment of 5–15 ms of the subsequent frame is also available. The frame may further be divided into a number of subframes. For every frame, the encoder determines a parametric representation of the input signal. The parameters are quantized, and transmitted through a communication channel or stored in a storage medium in a digital form. At the receiving end, the decoder constructs a synthesized signal based on the received parameters.

Most current speech coders include a linear prediction (LP) filter, for which an excitation signal is generated. The LP filter typically has an all-pole structure, as given by the following equation:

$$\frac{1}{A(z)} = \frac{1}{1 + a_1 z^{-1} + a_2 z^{-2} + \ldots + a_p z^{-p}}, \tag{1}$$

where A(z) is an inverse filter with unquantized LP coefficients $a_1, a_2, \ldots, a_p$ and p is the predictor order, which is usually 8–12.

The input speech signal is processed in frames. For each speech frame, the encoder determines the LP coefficients using, for example, the Levinson-Durbin algorithm. (see "AMR Speech Codec; Transcoding functions" 3G TS 26.090 v3.1.0 (1999-12)). Line spectral frequency (LSF) representation or other similar representations, such as line spectral pair (LSP), immittance spectral frequency (ISF) and immittance spectral pair (ISP), where the resulting stable filter is represented by an order vector, are employed for quantization of the coefficients, because they have good quantization properties. For intermediate subframes, the coefficients are linearly interpolated using the LSF representation.

In order to define the LSFs, the inverse LP filter A(z) polynomial is used to construct two polynomials:

$$P(z)=A(z)+z^{-(p+1)}A(z^{-1}), =(1-z^{-1})\kappa(1-2z^{-1}\cos\omega_i+z^{-2}),\ i=2, 4, \ldots, p \tag{2}$$

and $$Q(z)=A(z)-z^{-(p+1)}A(z^{-1})=(1-z^{-1})\kappa(1-2z^{-1}\cos\omega_i+z^{-2}),\ i=1, 3, \ldots, p-1. \tag{3}$$

The roots of the polynomials P(z) and Q(z) are called LSF coefficients. All the roots of these polynomials are on the unit circle $e^{j\omega i}$ with i=1, 2, . . . p. The polynomials P(z) and Q(z) have the following properties: 1) all zeros (roots) of the polynomials are on the unit circle 2) the zeros of P(z) and Q(z) are interlaced with each other. More specifically, the following relationship is always satisfied:

$$0=\omega_0<\omega_1<\omega_2<\ldots<\omega_{p-1}<\omega_p<\omega_{p+1}=\pi \tag{4}$$

This ascending ordering guarantees the filter stability, which is often required in speech coding applications. Note, that the first and last parameters are always 0 and π respectively, and only p values have to be transmitted.

While in speech coders efficient representation is needed for storing the LSF information, the LSFs are quantized using vector quantization (VQ), often together with prediction (see FIG. 1). Usually, the predicted values are estimated based on the previously decoded output values (AR (autoregressive)—predictor) or previously quantized values (MA (moving average)—predictor).

$$pLSF_k = mLSF + \sum_{j=1}^{m} A_j(qLSF_{k-j} - mLSF) + \sum_{i=1}^{n} B_i CB_{k-i}, \tag{5}$$

where $A_j$s and $B_i$s are the predictor matrices, and m and n the orders of the predictors. $pLSF_k$, $qLSF_k$ and $CB_k$ are, respectively, the predicted LSF, quantized LSF and codebook vector for the frame k. mLSK is the mean LSF vector.

After the predicted value is calculated, the quantized LSF value can be obtained:

$$qLSF_k=pLSF_k+CB_k, \tag{6}$$

where $CB_k$ is the optimal codebook entry for the frame k.

In practice, when using predictive quantization or constrained VQ, the stability of the resulting $qLSF_k$ has to be checked before conversion to LP coefficients. Only in case of direct VQ (non-predictive, single stage, unsplit) the codebook can be designed so that the resulting quantized vector is always in order.

In prior art solutions, the filter stability is guaranteed by ordering the LSF vector after the quantization and codebook selection.

While searching for the best codebook vector, often all vectors are tried out (full search) and some perceptually important goodness measure is calculated for every instance. The block diagram of a commonly used search procedure is shown in FIG. 1*a*.

Optimally, selection is based on spectral distortion $SD^i$ as follows:

$$SD = \frac{1}{\pi}\int_0^{\pi}\left[\log S(\omega) - \log\hat{S}(\omega)\right]^2 d\omega, \tag{7}$$

where $\hat{S}(\omega)$ and S (ω) are the spectra of the speech frame with and without quantization, respectively. This is computationally very intensive, and thus simpler methods are used instead.

A commonly used method is to weight the LSF error ($rLSF^i_k$) with weight ($W_k$). For example, the following weighting is used (see "AMR Speech Codec; Transcoding functions" 3G TS 26.090 v3.1.0 (1999-12)):

$$W_k = 3.347 - \frac{1.547}{450} d_k \quad \text{for } d_k < 450 \text{ Hz} \qquad (8)$$
$$= 1.8 - \frac{0.8}{1050}(450 - d_k) \quad \text{otherwise,}$$

where $d_k = LSF_{k+1} - LSF_{k-1}$ with $LSF_0 = 0$ Hz and $LSF_{11} = 4000$ Hz.

Basically, this distortion measurement depends on the distances between the LSF frequencies. The closer the LSFs are to each other, the more weighting they get. Perceptually, this means that formant regions are quantized more precisely.

Based on the distortion value, the codebook vector giving the lowest value is selected as the best codebook index. Normally, the criterion is $$\min_i\{SD^i\} = \sum_{k=1}^{p} (LSF_k - pLSF_k - CB_k^i)^2 W_k^2, \qquad (9)$$

As can be seen in FIG. 1*a*, the difference between a target LSF coefficients $LSF_k$ and a respective predicted LSF coefficients $pLSF_k$ is first determined in a summing device 12, and the difference is further adjusted by a respective residual codebook vector $CB^j_{1k}$ of the jth codebook entry in another summing device 14. Equation 9 can be reduced to $$\min\{SD^i\} = \sum_{k=1}^{p} (LSF_k - qLSF_k^i)^2 W_k^2, \qquad (10)$$

and further reduced to $$\min_i\{SD^i\} = \sum_{k=1}^{p} (rLSF_k^i)^2 W_k^2, \qquad (11)$$

The reduction steps, as shown in Equations 10 and 11, can be visualized easier in an encoder, as shown in FIG. 1*b*. As shown in FIG. 1*b*, a summing device 16 is used to compute the quantized LSF coefficients. Subsequently, the LSF error is computed by the summing device 18 from the quantized LSF coefficients and the target LSF coefficients.

Prior art solutions do not necessarily find the optimal codebook index if the quantized LSF coefficients $qLSF_k^i$ are not in ascending order regarding k. FIGS. 2*a*–2*e* illustrate such a problem. For simplicity, only the first three LSF coefficients are shown (k=1,2,3). However, this simplified demonstration adequately represents the rather usual first split in the case of split VQ. The target LSF vector is marked with $LSF_1 \ldots LSF_3$, and the predicted values, based on the LSF of the previous frames, are also shown ($pLSF_1 \ldots pLSF_3$). As shown in FIG. 2*a*, while some predicted values are greater than the respective target vectors, some are smaller. The first codebook entry in the vector quantizer residual codebook might look like the codebook vectors, as shown in FIG. 2*b*. With $qLSF^1_{1-3} = pLSF_{1-3} + CB^1_{1-3}$, the quantized LSF coefficients are calculated and shown in FIG. 2*c*. For simplicity, no weight is used, or $W_k = 1$, and the spectral distortion is directly proportional to the squared or absolute distance between the target and the quantization value (the quantized LSF coefficient). The distance between the target and the quantization value is $rLSF^i_k$. The total distortion for the first split is thus $$SD^1 = \sum_{k=1}^{3} SD_k^1. \qquad (12)$$

The second codebook entry (not shown) could yield the quantized LSF vector ($qLSF^2_{1-3}$) and the spectral distortion ($SD^2_{1-3}$), as shown in FIG. 2*d*. When FIG. 2*d* is compared to FIG. 2*c*, the resulting qLSF vectors are quite different, but the total distortions are almost the same, or ($SD^1 \approx SD^2$). With the first two codebook entries, the resulting quantized LSF vectors are in order.

In order to show the problem associated with the prior art quantization method, it is assumed that the quantized LSF coefficients ($qLSF^3_{1-3}$) and the corresponding spectral distortions ($SD^3_{1-3}$) resulted from the third codebook entry (not shown) are distributed, as shown in FIG. 2*e*. The total distortion $$\left(SD^3 = \sum_{k=1}^{3} SD_k^3\right),$$

according to the spectral distortion, as shown in FIG. 2*e*, is a very big value. This means that, according to the prior art method, the best codebook index from this first split is the smaller of $SD^1$ and $SD^2$. However, this selected "best" codebook index, as will be illustrated later in FIG. 4*a*, does not yield the optimal code vector. This is because the resulting quantized LSF vectors are out of order regarding the third codebook entry.

Generally, speech coders require that the linear prediction (LP) filter used therein be stable. Prior art codebook search routine, such as that illustrated in FIG. 1*a*, might cause the resulting quantized LSF vectors to be out of order and become unstable. In prior art, stabilization of vector is achieved by sorting the LSF vectors after quantization. However, the obtained code vector may not be optimal.

It should be noted that spectral (pair) parameter vectors, such as line spectral pair (LSP) vectors, immittance spectral frequency (ISF) vectors and immittance spectral pair (ISP) vectors, that represent the linear predictive coefficients must also be ordered to be stable.

It is advantageous and desirable to provide a method and system for spectral parameter (or representation) quantization, wherein the obtained code vector is optimized.

SUMMARY OF THE INVENTION

It is a primary object of the present invention to provide a method and apparatus for spectral parameter quantization, wherein an optimized code vector is selected for improving the spectral parameter quantization performance in terms of spectral distortion, while maintaining the original bit allocation. This object can be achieved by rearranging the quantized spectral parameter vectors in an orderly fashion in the frequency domain before the code vector is selected based on the spectral distortion.

Thus, according to the first aspect of the present invention, a method of quantizing spectral parameter vectors in a speech coder, wherein a linear predictive filter is used to compute a plurality of spectral parameter coefficients in a frequency domain, and wherein a pluraltiy of predicted spectral parameter values based on previously decoded output values, and a plurality of residual codebook vectors, along with said plurality of spectral parameter coefficients, are used to estimate spectral distortion, and the optimal code vector is selected based on the spectral distortion, said method comprising the steps of:

obtaining a plurality of quantized spectral parameter coefficients from the respective predicted spectral parameter values and the residual codebook vectors;

rearranging the quantized spectral parameter coefficients in the frequency domain in an orderly fashion; and obtaining the spectral distortion from the rearranged quantized spectral parameter coefficients and the respective line spectral frequency coefficients.

Preferably, the spectral distortion is computed based an error indicative of a difference between each of the rearranged quantized spectral parameter coefficients and the respective spectral parameter coefficient, wherein the error is weighted prior to computing the spectral distortion based on the spectral parameter coefficients.

The method, according to the present invention, is applicable when the rearranging of the quantized spectral parameter coefficients is carried out in a single split.

The method, according to the present invention, is also applicable when the rearranging of the quantized spectral parameter coefficient is carried out in a plurality of splits. In that case, an optimal code vector is selected based on the spectral distortion in each split.

The method, according to the present invention, is also applicable when the rearranging of the quantized spectral parameter coefficient is carried out in one or more stages in case of multistage quantization. In that case, an optimal code vector is selected based on the spectral distortion in each stage. Each stage can be either sorted or unsorted. It is preferred that the selection as to which stages are sorted and which are not be determined beforehand. Otherwise the sorting information has to be sent to the receiver as side information.

The method, according to the present invention, is applicable when the rearranging of the quantized spectral parameter coefficients is carried out as an optimization stage for an amount of preselected vectors. The proponent vectors are sorted and the final index selection is made from this preselected set of vectors using the disclosed method.

The method, according to the present invention, is applicable wherein the rearranging step is carried out as an optimization stage, where initial indices to the code book (for stages or splits) are selected without rearranging and the final selection is carried out based only on the selection of the best preselected vectors with the disclosed sorting method.

The spectral parameter can be line spectral frequency, line spectral pair, immittance spectral frequency, immittance spectral pair, and the like.

According to the second aspect of the present invention, an apparatus for quantizing spectral parameter vectors in a speech coder, wherein a linear predictive filter is used to compute a plurality of spectral parameter coefficients in a frequency domain, and wherein a pluraltiy of predicted spectral parameter values based on previously decoded output values, and a plurality of residual codebook vectors, along with said plurality of spectral parameter coefficients, are used to estimate spectral distortion for allowing the optimal code vector to be selected based on the spectral distortion, said apparatus comprising:

means, for obtaining a plurality of quantized spectral parameter coefficients from the respective predicted spectral parameter values and the residual codebook vectors for providing a series of first signals indicative of the quantized spectral parameter coefficients;

means, responsive to the first signals, for rearranging the quantized spectral parameter coefficients in the frequency domain in an orderly fashion for providing a series of second signals indicative of the rearranged quantized spectral parameter coefficients; and means, responsive to the second signals, for obtaining the spectral distortion from the rearranged quantized spectral parameter coefficients and the respective spectral parameter coefficients.

The spectral parameter can be line spectral frequency, line spectral pair, immittance spectral frequency, immittance spectral pair and the like.

According to the third aspect of the present invention, a speech encoder for providing a bitstream to a decoder, wherein the bitstream contains a first transmission signal indicative of code parameters, gain parameters and pitch parameters and a second transmission signal indicative of spectral representation parameters, wherein an excitation search module is used to provide the code parameters, the gain parameters and the pitch parameters, and a linear prediction analysis module is used to provide a plurality of spectral representation coefficients in a frequency domain, a plurality of predicted spectral representation values based on previously decoded output values, and a plurality of residual codebook vectors, said encoder comprising:

means, for obtaining a plurality of quantized spectral representation coefficients based on the respective predicted spectral representation values and the residual codebook vectors for providing a series of first signals indicative of the quantized spectral representation coefficients;

means, responsive to the first signals, for rearranging the quantized spectral representation coefficients in the frequency domain in an orderly fashion for providing a series of second signals indicative of the rearranged quantized spectral representation coefficients;

means, responsive to the second signals, for obtaining the spectral distortion from the rearranged quantized spectral representation coefficients and the respective spectral representation coefficients for providing a series of third signals; and means, response to the third signals, for selecting a plurality of optimal code vectors representative of the spectral representation parameters based on the spectral distortion and for providing the second transmission signal indicative of optimal code vectors.

According to the fourth aspect of the present invention, a mobile station capable of receiving and preprocessing input speech for providing a bitstream to at least one base station in a telecommunications network, wherein the bitstream contains a first transmission signal indicative of code parameters, gain parameters and pitch parameters, and a second transmission signal indicative of spectral representation parameters, wherein an excitation search module is used to provide the first transmission signal from the preprocessed input signal, and a linear prediction module is used to provide, based on the preprocessed input signal, a plurality of spectral representation coefficients in a frequency domain, a pluraltiy of predicted spectral representation values based on previously decoded output values, and a plurality of residual codebook vectors, said mobile station comprising:

means, for obtaining a plurality of quantized spectral representation coefficients from the respective predicted spectral representation values and the residual codebook vectors for providing a series of first signals indicative of the quantized spectral representation coefficients;

means, responsive to the series of first signals, for rearranging the quantized spectral representation coefficients in the frequency domain in an orderly fashion for providing a series of second signals indicative of the rearranged quantized spectral representation coefficients;

means, responsive to the series of second signals, for obtaining the spectral distortion from the rearranged quantized spectral representation coefficients and the respective spectral representation for providing a series of third signals;

means, for selecting from the spectral distortion a plurality of optimal code vectors representative of spectral representation parameters for providing the second transmission signal.

The present invention will become apparent upon reading the description taken in conjunction to FIGS. 3 to 6.

DETAILED DESCRIPTION OF THE INVENTION

Spectral (pair) parameter vector is the vector that represents the linear predictive coefficients so that the stable spectral (pair) vector is always ordered. Such representations include line spectral frequency (LSF), line spectral pair (LSP), immittance spectral frequency (ISF), immittance spectral pair (ISP) and the like. For simplicity, the present invention is described in terms of the LSF representation.

Figure 1A:
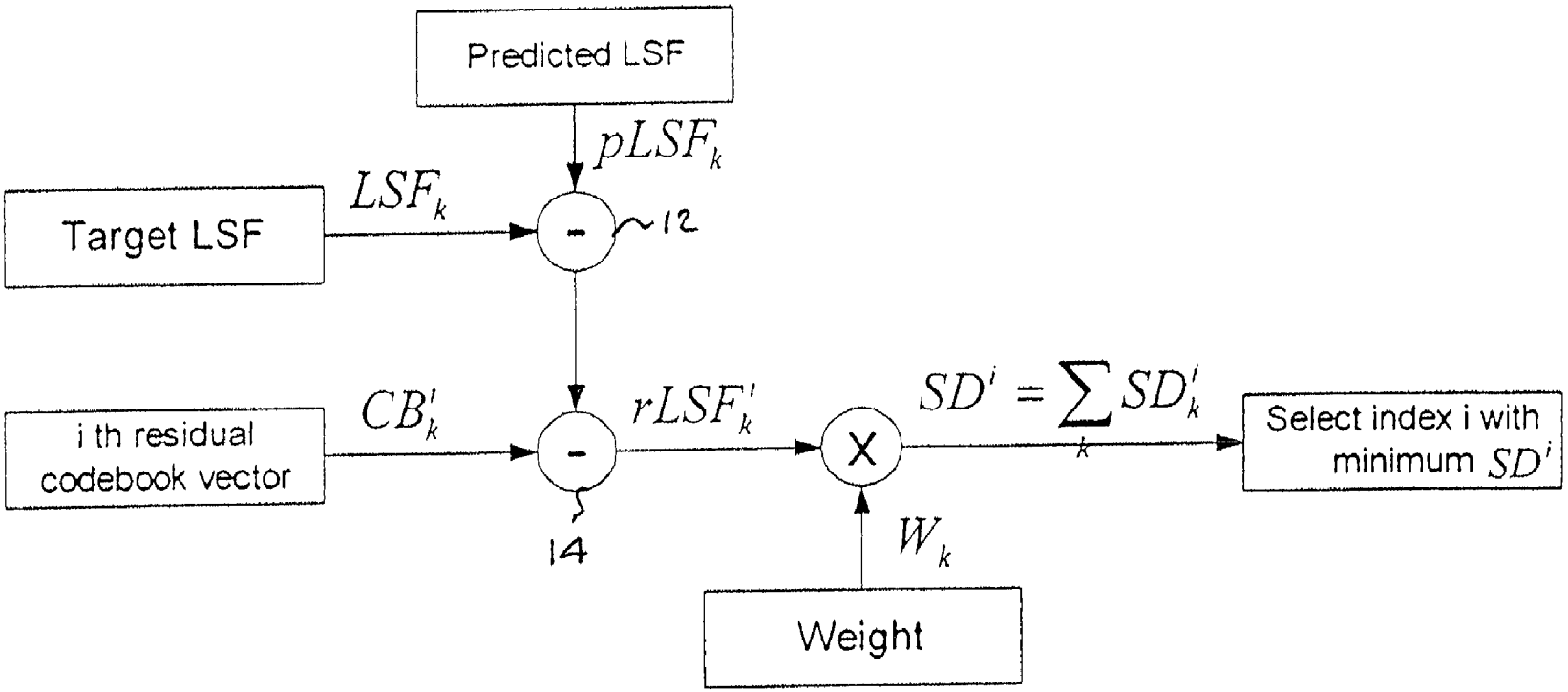
FIG. 1*a* is a block diagram illustrating a prior art LSF quantization system.
Figure 1B:
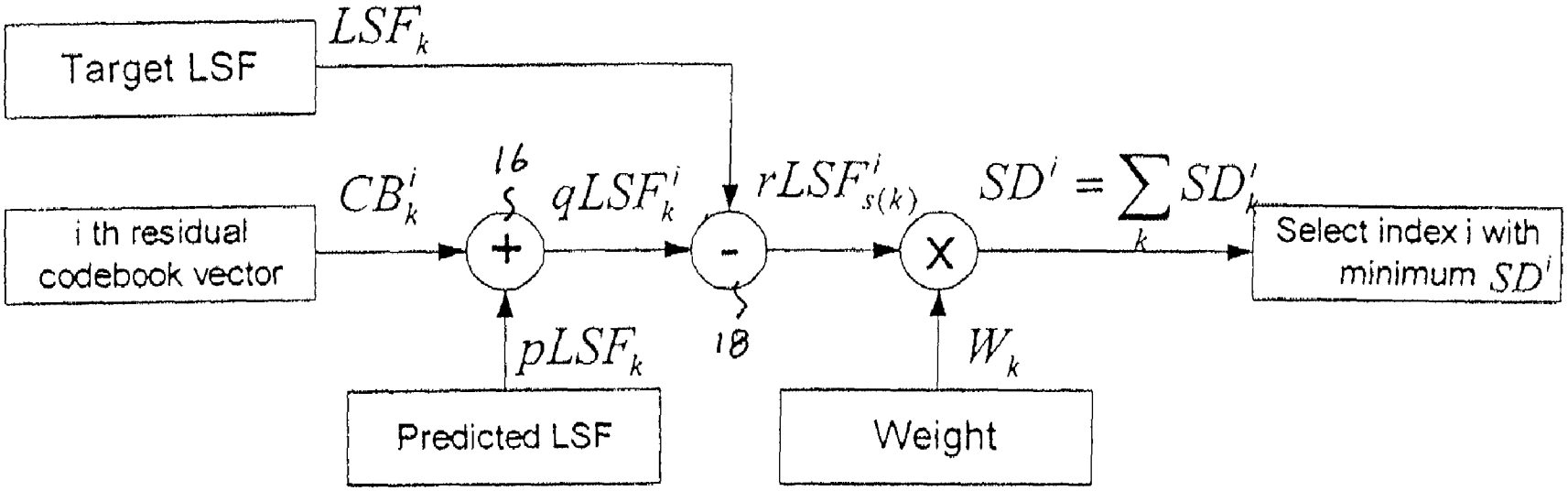
FIG. 1*b* is a block diagram illustrating the prior art LSF quantization system with a different arrangement of system components.
Figure 2A:
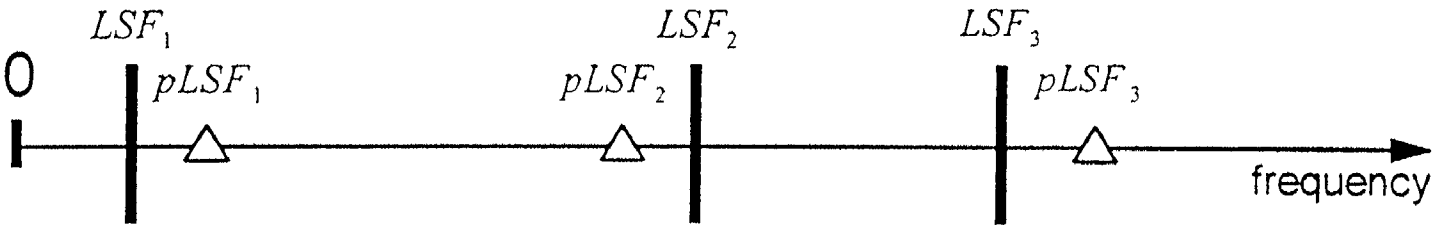
FIG. 2*a* is a diagrammatic representation illustrating the distribution of the target LSF vector and predicted LSF values in the frequency domain.
Figure 2B:
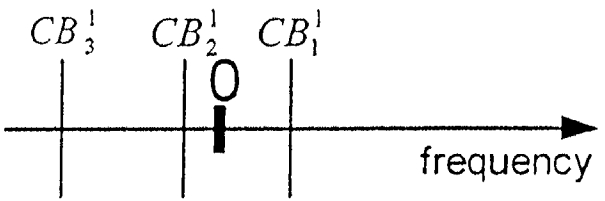
FIG. 2*b* is a diagrammatic representation illustrating the first codebook entry in vector quantizer residual codebook.
Figure 2C:
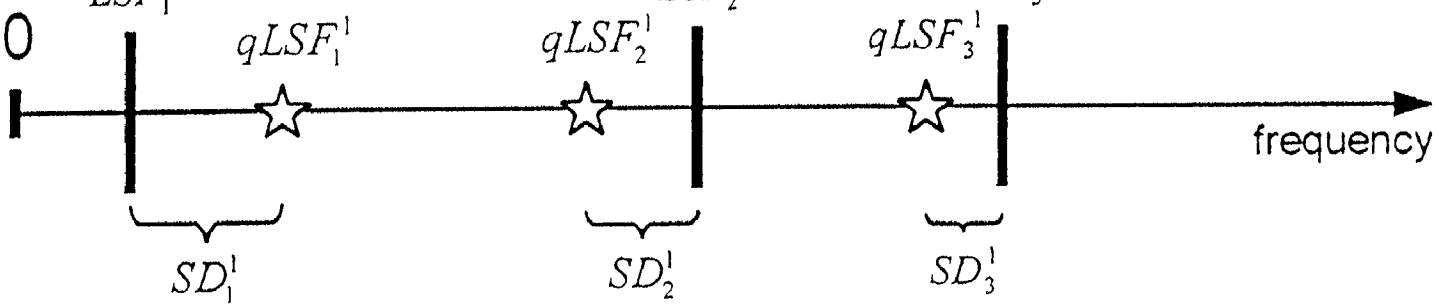
FIG. 2*c* is a diagrammatic representation illustrating the quantized LSF coefficients as compared to the target LSF vector, and the resulting spectral distortion with the first codebook entry.
Figure 2D:
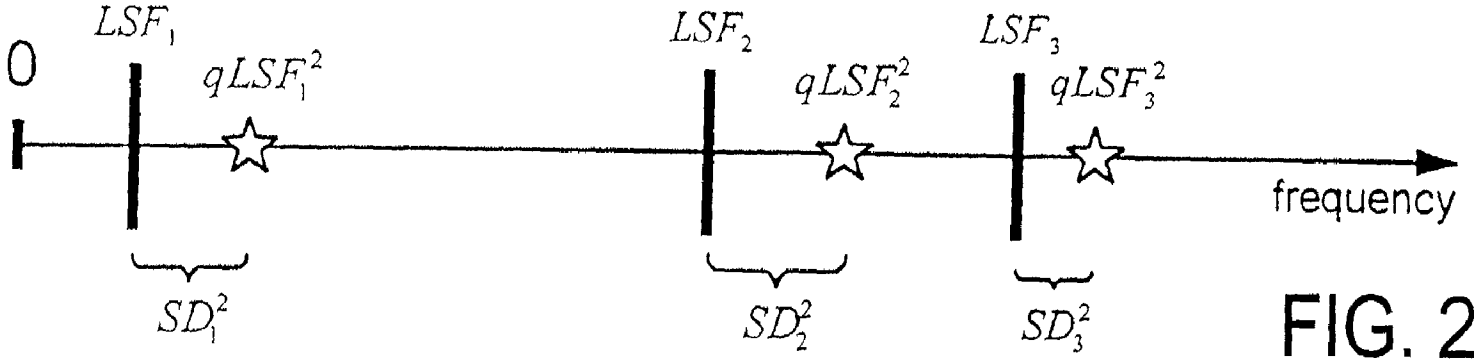
FIG. 2*d* is a diagrammatic representation illustrating the quantized LSF coefficients and the resulting spectral distortion with the second codebook entry.
Figure 2E:
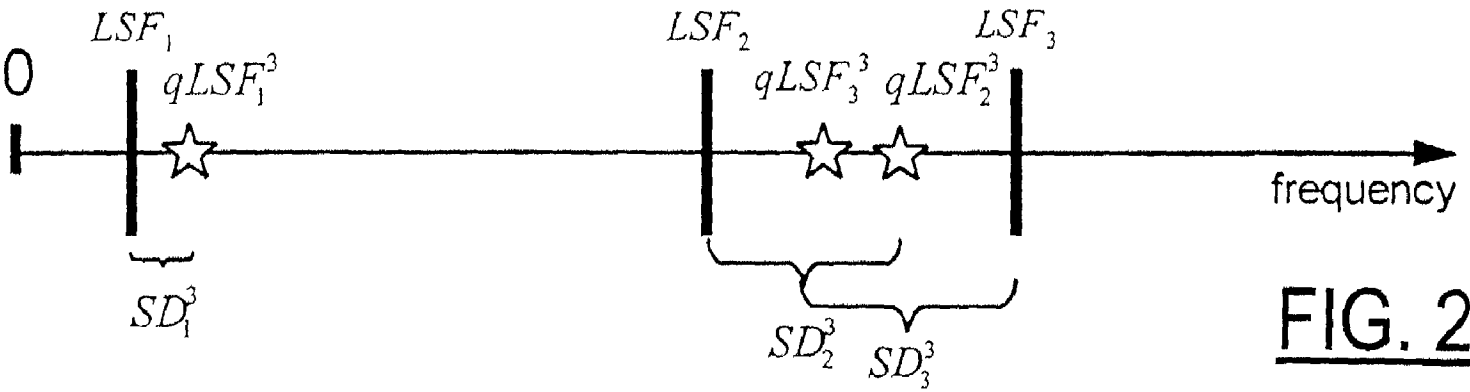
FIG. 2*e* is a diagrammatic representation illustrating the quantized LSF coefficients and the resulting spectral distortion with the third codebook entry.
Figure 3:
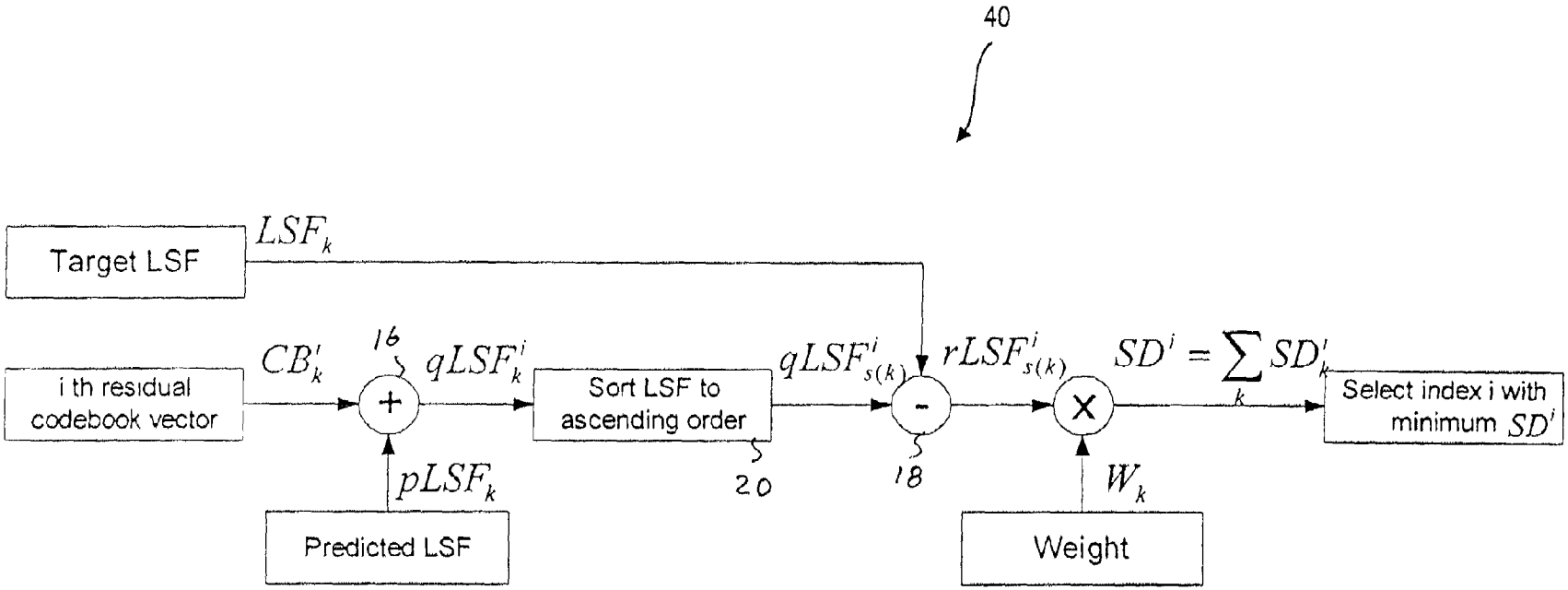
FIG. 3 is a block diagram illustrating the LSF quantization system, according to the present invention.
Figure 4A:
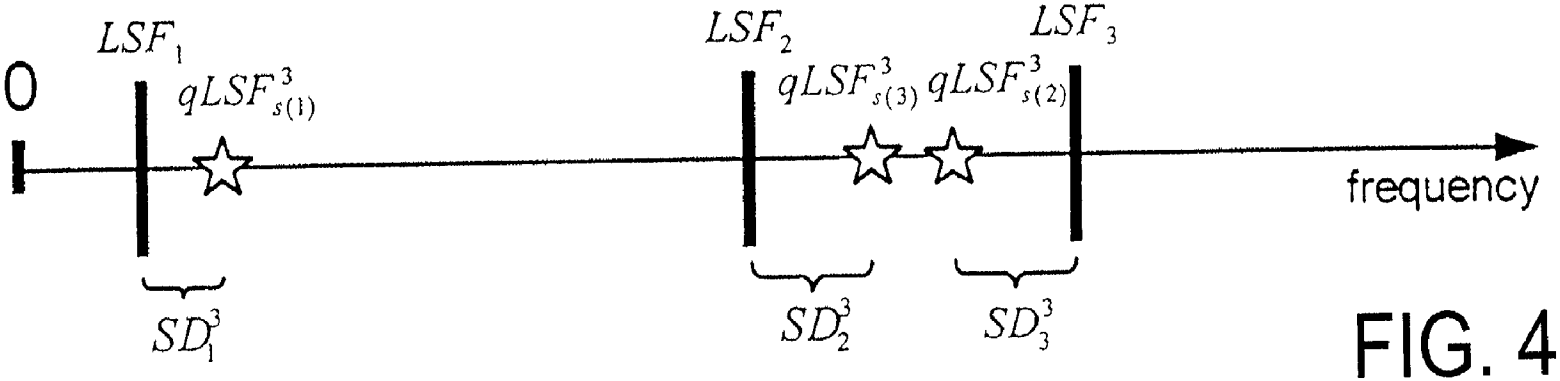
FIG. 4*a* is a diagrammatic representation illustrating the quantized LSF coefficients and the resulting spectral distortion with the third codebook entry, as shown in FIG. 2*e*, after being rearranged by the LSF quantization system, according to the present invention.

The LSF quantization system 40, according to the present invention, is shown in FIG. 3. In addition to the system components, as shown in FIG. 1*a*, a sorting mechanism 20 is implemented between the summing device 16 and the summing device 18. The sorting mechanism 20 is used to rearrange the quantized LSF coefficients $qLSF^i_k$ so that they are distributed in an ascending order regarding the frequency. For example, the quantized LSF coefficients $qLSF^1_k$ and $qLSF^2_k$, as shown in FIGS. 2*a* and 2*b*, are already in an ascending order, or $qLSF^i_1<qLSF^i_2<qLSF^i_3$, and the function of the sorting mechanism 20 does not affect the distribution of these quantized LSF coefficients. In this case, the quantized LSF vector $qLSF^i$ is said to be in proper order. However, the quantized LSF vector $qLSF^3$, as shown in FIG. 2*e*, is out of order, because $qLSF^3_1<qLSF^3_3<qLSF^3_2$. After being arranged, the quantized LSF coefficients are distributed in an ascending order, as shown in FIG. 4*a*.

After vector ordering, the total spectral distortion $SD^3$ (FIG. 4*a*) is smaller than either $SD^1$ or $SD^2$. Accordingly, the best codebook index from the first split containing the first three frames to be selected is i=3. The correct order of decoded codebook (1 3 2) is also automatically found in the decoder due to sorting and no extra information is needed.

The sorting function, as performed by the sorting mechanism 20, can be expressed as follows:

$$\begin{aligned}\min\{SD^i\} &= \sum_{k=1}^{p}(LSF_k - \mathrm{sort}(pLSF_k + CB_k^i)^2 W_k^2 \\ &= \sum_{k=1}^{p}(LSF_k - \mathrm{sort}(qLSF_k^i))^2 W_k^2,\end{aligned} \tag{13}$$

Equation 13 can be further reduced to $$\begin{aligned}\min\{SD^i\} &= \sum_{k=1}^{p}(LSF_k - qLSF_{s(k)}^i)^2 W_k^2 \\ &= \sum_{k=1}^{p}(rLSF_{s(k)}^i)^2 W_k^2,\end{aligned} \tag{14}$$

where s(k) is a permutation function that gives the correct ordering for the current $k^{th}$ LSF components, such that all $LSF^i_k$'s are in an scending order before $SD^i$ calculation.

According to the present invention, the spectral distortion value is calculated after the quantized vector is put in order, instead of comparing residual vectors, which might result in an invalid ordered LSF vector.

Figure 2F:
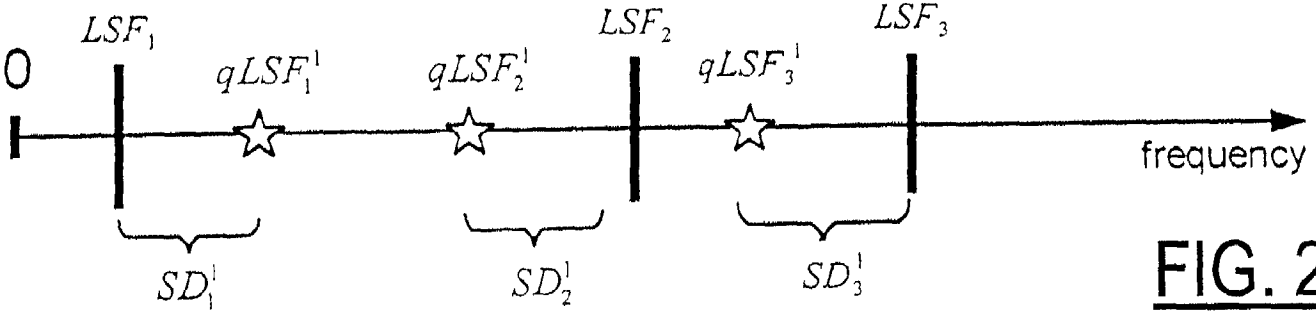
FIG. 2*f* is a diagrammatic representation illustrating the quantized LSF coefficients and the resulting spectral distortion with the fourth codebook entry.
Figure 2G:
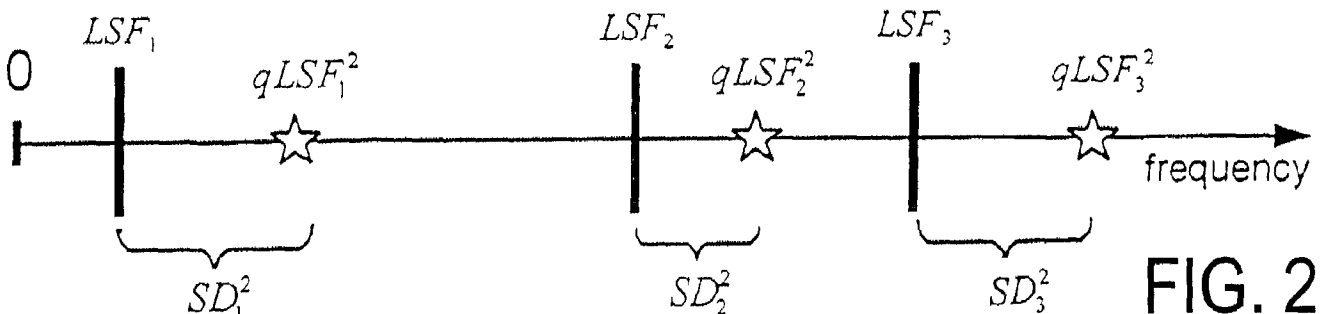
FIG. 2*g* is a diagrammatic representation illustrating the quantized LSF coefficients and the resulting spectral distortion with a different first codebook entry from that shown in FIG. 2*c*.

It should be noted that in some cases, it is possible to use the prior art search method to obtain the lowest spectral distortion $SD^i$ from the quantized LSF coefficients that are not arranged in ascending order. For example, the first and second codebook entries yield two different sets of quantized LSF coefficients $qLSF^1_k$ and $qLSF^2_k$, as shown in FIG. 2*f* and FIG. 2*g*, while the third quantized LSF coefficients $qLSF^3_k$ are the same as those shown in FIG. 2*e*. In that case, the lowest spectral distortion is resulted from the third codebook entry, although the quantized LSF coefficients $qLSF^3_k$ are not in an ascending order. Thus, the quantized LSF vector being selected based on the lowest total spectral distortion is unstable. In prior art coder, the unstable quantized LSF vector can be stabilized by sorting the quantized LSF coefficients after codebook selection. In this particular case, the result from the prior art speech codec and the speech codec, according to the present invention, is the same.

Figure 2H:
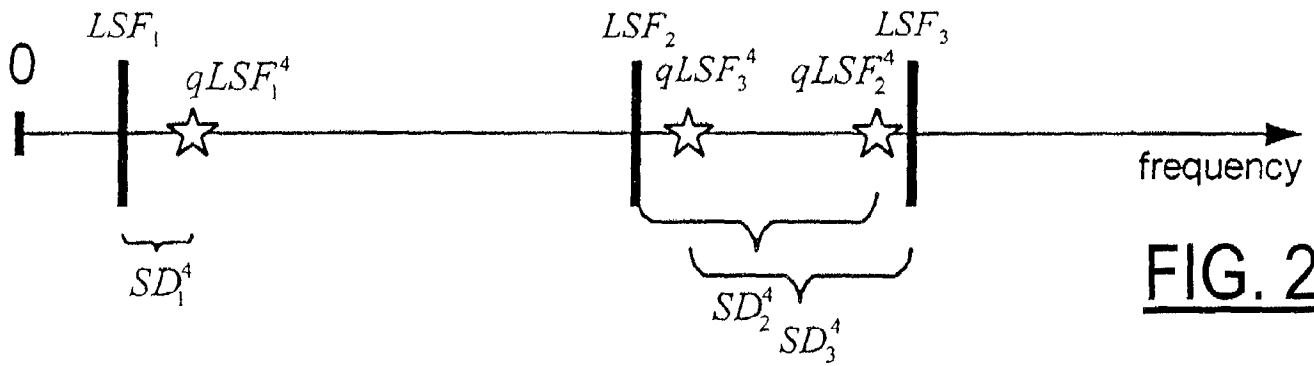
FIG. 2*h* is a diagrammatic representation illustrating the quantized LSF coefficients and the resulting spectral distortion with a different second entry from that shown in FIG. 2*d*.

In general, the result according to the prior art method might not be optimal, because there could be another quantized vector that is also in the wrong order. For example, if the fourth codebook entry yields a set of quantized LSF coefficients $qLSF^4_k$, as shown in FIG. 2*h*, this quantized LSF vector has the greatest spectral distortion among the quantized vectors as shown in FIGS. 2*e*, 2*f*, 2*g* and 2*h*. With the prior art codebook search routines, the lowest total spectral distortion is resulted from the third codebook entry (FIG. 2*g*).

Figure 4B:
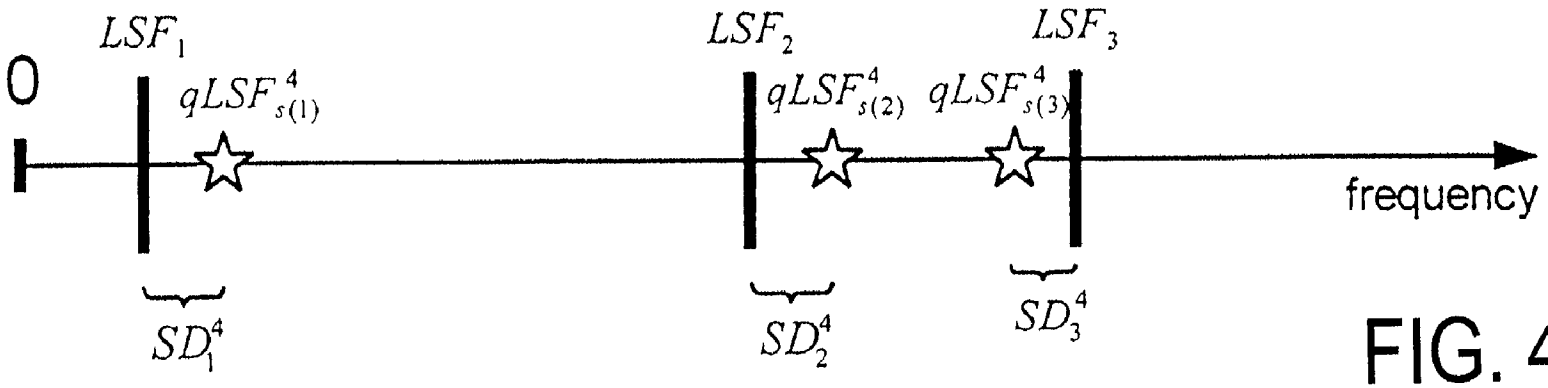
FIG. 4*b* is a diagrammatic representation illustrating the quantized LSF coefficients and the resulting spectral distortion with the fourth codebook entry, as shown in FIG. 2*f*, after being rearranged by the LSF quantization system, according to the present invention.

According to the LSF quantization method, according to the present invention, the quantized LSF coefficients in FIG. 2*e* and FIG. 2*h* are rearranged by the sorting mechanism 20. After the quantized LSF coefficents $qLSF^4_k$, as shown in FIG. 2*h*, are rearranged to put the quantized LSF coefficients in an ascending order, the result is shown in FIG. 4*b*. Compared to the quantized LSF vectors, as shown in FIGS. 2*f*, 2*g* and 4*a*, the quantized LSF vector, as shown in FIG. 4*b*, has the lowest total spectral distortion.

The above examples have demonstrated that vector stabilization after quantization (by sorting LSF vector), according to prior art codebook search routines, does not always result in the best vector, in terms of spectral distortion.

With the LSF quantization method, according to the present invention, the LSF vectors are put in order before they are selected for transmission. This method always find the best vectors. If the vector quantizer codebook is in one split and the selection of the best vector is done in a single stage, the found vector is the global optimum. This means that the global minimum error-providing index i for the frame is always found. If a constrained vector quantizer is used, global optimum is not necessarily found. However, even if the present method is used only inside a split or stage, the performance still improves. In order to find even more global optimum for the split VQ, the following approaches can be used:

1) Find the best codebook index for the first split using the pre-sort method, according to the present invention, and 2) separately find the best codebook index for the second split, third split, and so on, in the same fashion.

However, in order to find a more optimal solution, instead of saving only the best split quantizer index for each split, a number of better indices can be saved. Then all the index combinations for splits based on the saved indices are tried out and the resulting sorted quantized LSF vector ($qLSF_1 \ldots qLSF_p$) is generated and $SD^i$ is calculated. Finally, the best combination of codebook indices is selected.

A similar approach can be used for multistage vector quantizers as follows: A number of the best first stage quantizers are selected in the so-called M-best search and later stages are added on top of these. At each stage the resulting qLSF is sorted, if so desired, and $SD^i$ is calculated. Again, the best combination of codebook indices is sent to the receiver. Sorting can be used for one or more internal stages. In that case, the decoder has to do the sorting in the same stages in order to decode correctly (the stages where there is sorting can be determined during the design stage).

For the split vector quantizer, the following procedure can be used:

1) For the first split do the optimal codebook search;

2) Weight the last coefficient's error slightly less than what is done normally;

3) Memorize a number of the better indices for use in the next phase;

4) Go to the next split—instead of calculating the error inside the split, calculate the error including all combinations of the first split's values and the current vector (after ordering of course); and 5) Repeating the same procedure until all splits are calculated.

This method tries continuously to include some selection of the quantized values, which are the best found values so far. After the new split is added, the resulting longer vector is ordered and, based on the distortion, the previous split's index can be settled. Thus the restricting effect of ordering over splits is somewhat taken into account. The meaning of lower weighting on the last coefficient is that the last coefficient could be replaced with a value from a later split after ordering is done.

Figure 5:
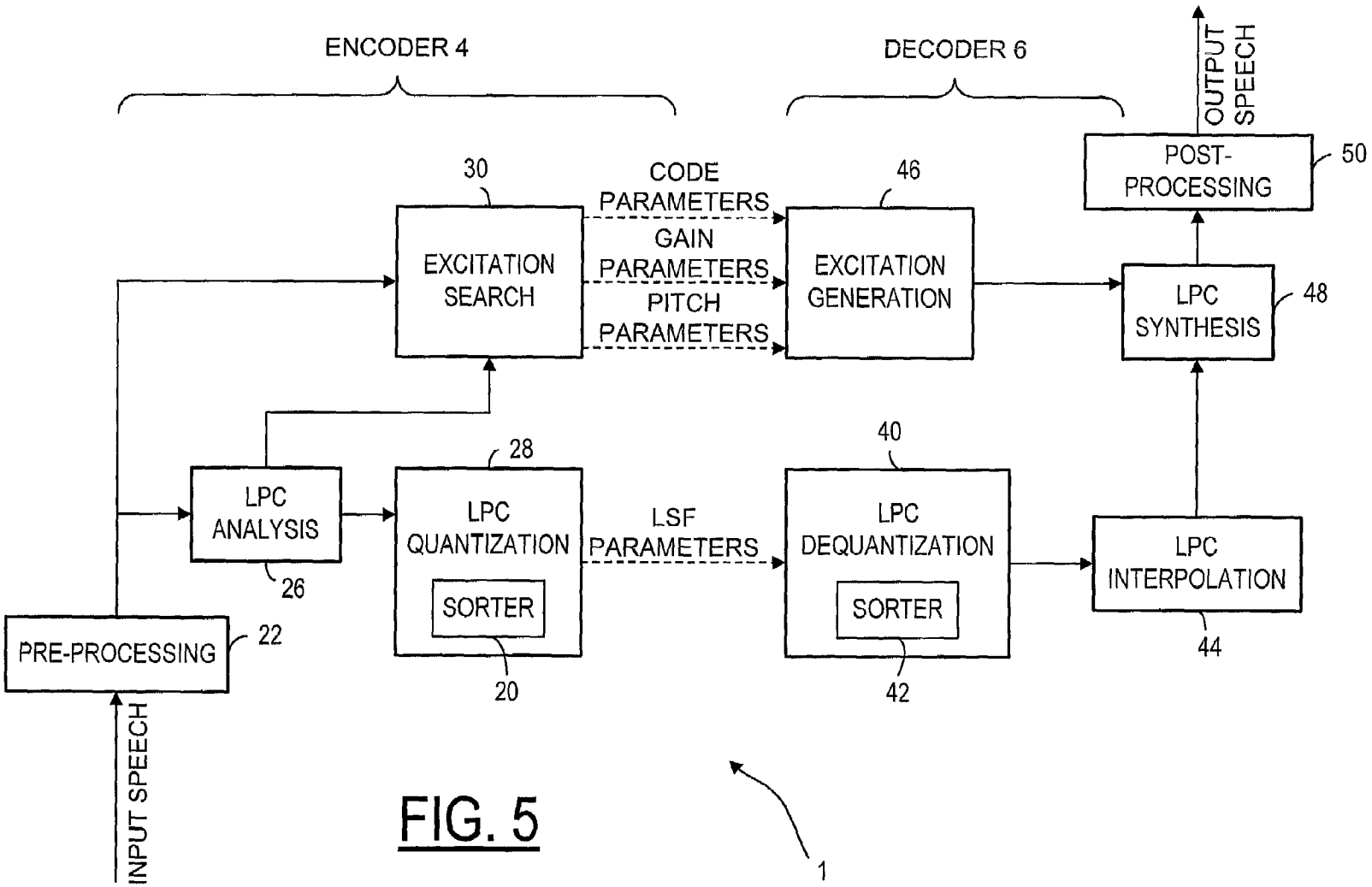
FIG. 5 is a block diagram illustrating a speech codec comprising an encoder and a decoder for speech coding, according to the present invention.

FIG. 5 is a block diagram illustrating the speech codec 1, according to the present invention. The speech codec 1 comprises an encoder 4 and a decoder 6. The encoder 4 comprises a preprocessing unit 22 to high-pass filter the input speech signal. Based on the pre-processed input signal, a linear predictive coefficient (LPC) analysis unit 26 is used to carry out the estimation of the LP filter coefficients. The LP coefficients are quantized by a LPC quantization unit 28. An excitation search unit 30 is used to provide the code parameters, gain parameters and pitch parameters to the decoder 6, also based on the pre-processed input signal. The pre-processing unit 22, the LPC analysis unit 26, the LPC quantization unit 28 and the excitation search unit 30 and their functions are known in the art. The unique feature of the encoder 4 of the present invention is the sorting mechanism 20, which is used to rearrange the quantized LSF coefficients for use in spectral distortion estimation prior to sending the LSF parameters to the decoder 6. Similarly, the LPC quantization unit 40 in the decoder 6 has a sorting mechanism 42 to rearrange the received LSF coefficients prior to LPC interpolation by an LPC interpolation unit 44. The LPC interpolation unit 44, the excitation generation unit 46, the LPC synthesis unit 48 and the post-processing unit 50 are also known in the art.

Figure 6:
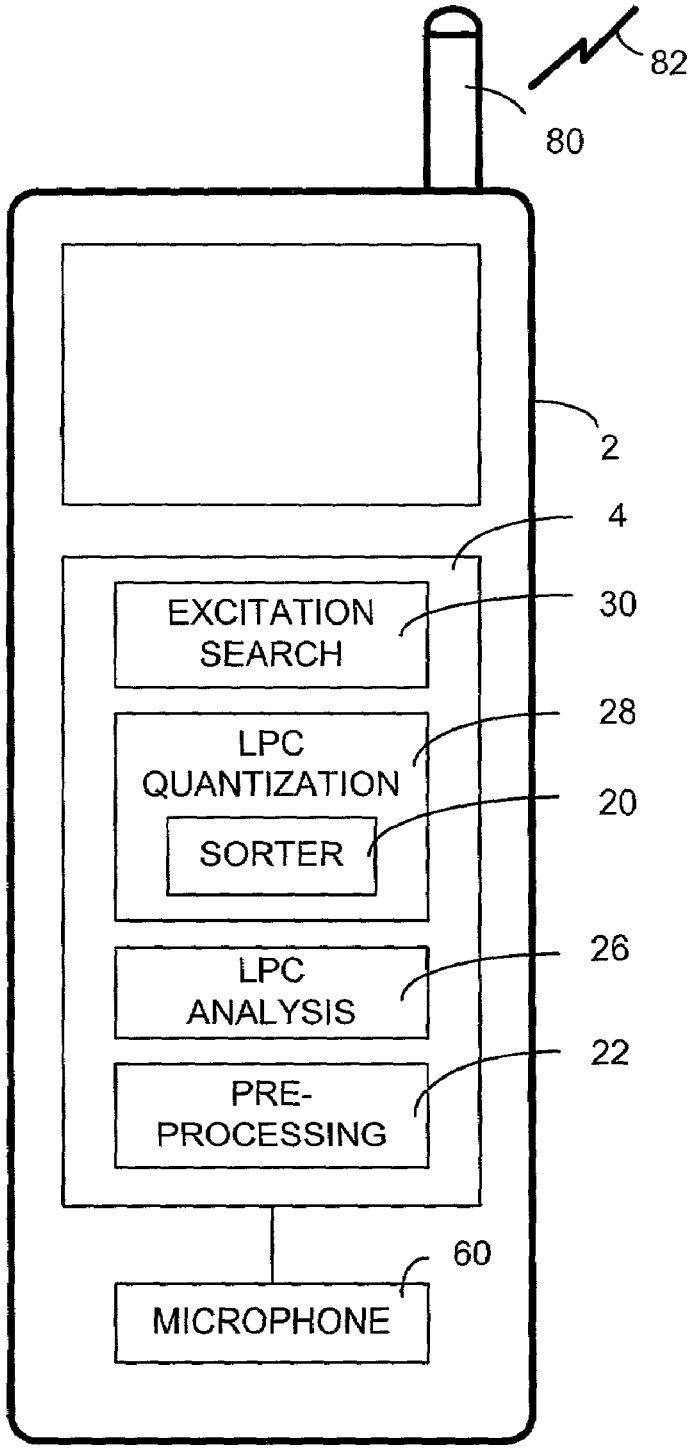
FIG. 6 is a diagrammatic representation illustrating a mobile station for use in a mobile telecommunications network, according to the present invention.

FIG. 6 is a diagrammatic representation illustrating a mobile phone 2 of the present invention. As shown in FIG. 6, the mobile phone has a microphone 60 for receiving input speech and conveying the input speech to the encoder 4. The encoder 4 has means (not shown) for converting the code parameters, gain parameters, pitch parameters and LSF parameters (FIG. 5) into a bitstream 82 for transmission via an antenna 80. The mobile phone 2 has a sorting mechanism 20 for ordering quantized vectors.

In summary, the present invention provides a method and apparatus for providing quantized LSF vectors, which are always stable. The method and apparatus, according to the present invention, improve LSF-quantization performance in terms of spectral distortion, while avoiding the need for changing bit allocation. The method and apparatus can be extended to both predictive and non-predictive split (partitioned) vector quantizers and multistage vector quantizers. The method and apparatus, according to the present invention, is more effective in improving the performance of a speech coder when higher-order LPC models (p>10) are used because, in those cases, LSFs are closer to each other and invalid ordering is more likely to happen. However, the same method and apparatus can also be used in speech coders based on lower-order LPC models p≦10).

It should be noted that the quantization method/apparatus, as described in accordance with LSF is also applicable to other representation of the linear predictive coefficients, such as LSP, ISF, ISP and other similar spectral parameters or spectral representations.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A method of quantizing spectral parameter vectors in a speech coder, wherein a linear predictive filter is used to compute a plurality of spectral parameter coefficients in a frequency domain, and wherein a pluraltiy of predicted spectral parameter values based on previously decoded output values, and a plurality of residual codebook vectors, along with said plurality of spectral parameter coefficients, are used to estimate spectral distortion for selecting an optimal code vector based on the spectral distortion, said method comprising the steps of:

obtaining a plurality of quantized spectral parameter coefficients from the respective predicted spectral parameter values and the residual codebook vectors for forming a quantized spectral representation, the representation having a plurality of elements indicative of said plurality of the quantized spectral parameter coefficients;

rearranging the quantized spectral parameter coefficients in the frequency domain in an orderly fashion such that the elements in the representation are distributed in an ascending order; and obtaining the spectral distortion from the rearranged quantized spectral parameter coefficients and the respective spectral parameter coefficients.

2. The method of claim 1, wherein the spectral distortion is computed based on an error indicative of a difference between each of the rearranged quantized spectral parameter coefficients and the respective spectral parameter coefficient.

3. The method of claim 2, further comprising the step of weighting the error prior to obtaining the spectral distortion based on the spectral parameter coefficients.

4. The method of claim 1, wherein the rearranging of the quantized spectral parameter coefficients is carried out in a single split.

5. The method of claim 1, wherein the rearranging of the quantized spectral parameter coefficient is carried out in a plurality of splits and an optimal code vector is selected based on the spectral distortion in each split.

6. The method of claim 1, wherein the spectral parameter comprises a line spectral frequency.

7. The method of claim 1, wherein the spectral parameter comprises a line spectral pair.

8. The method of claim 1, wherein the spectral parameter comprises an immittance spectral frequency.

9. The method of claim 1, wherein the spectral parameter comprises an immittance spectral pair.

10. The method of claim 1, wherein the rearranging step is carried in a single stage.

11. The method of claim 1, wherein the rearranging step is carried out in one of a plurality of stages for optimal code vector selection, wherein said one stage is predetermined and the selection of the optimal code vector is based on the spectral distortion in said one stage.

12. The method of claim 1, wherein the rearranging step is carried out in some of a plurality of stages for optimal code vector selection, wherein said some stages are predetermined and the selection of the optimal code vector is based on the spectral distortion in said some stages.

13. The method of claim 1, wherein the rearranging step is carried out in a plurality of stages for optimal code vector selection, wherein said plurality of stages are predetermined and the selection of the optimal code vector is based on the spectral distortion in said plurality of stages.

14. The method of claim 1, wherein the rearranging step is carried out as an optimization stage for a number of preselected vectors for optimal vector selection based on the preselected vectors.

15. An apparatus for quantizing spectral parameter vector in a speech coder, wherein a linear predictive filter is used to compute a plurality of spectral parameter coefficients in a frequency domain, and wherein a pluraltiy of predicted spectral parameter values based on previously decoded output values, and a plurality of residual codebook vectors, along with said plurality of spectral parameter coefficients, are used to estimate spectral distortion for allowing the optimal code vector to be selected based on the spectral distortion, said apparatus comprising:

means, for obtaining a plurality of quantized spectral parameter coefficients from the respective predicted spectral parameter values and the residual codebook vectors for forming a quantized spectral representation having a plurality of elements indicative of the quantized spectral parameter coefficients, said obtaining means further providing a series of first signals indicative of the quantized spectral parameter coefficients;

means, responsive to the first signals, for rearranging the quantized spectral parameter coefficients in the frequency domain in an orderly fashion such that the elements in the representation are distributed in an ascending order, said rearranging means further providing a series of second signals indicative of the rearranged quantized spectral parameter coefficients; and means, responsive to the second signals, for obtaining the spectral distortion from the rearranged quantized spectral parameter coefficients and the respective spectral parameter coefficients.

16. The apparatus of claim 15, wherein the spectral distortion is computed based on an error indicative of a difference between each of the rearranged quantized spectral parameter coefficients, and wherein the spectral distortion obtaining means weights the error based on the spectral parameter coefficients prior to obtaining the spectral distortion.

17. The apparatus of claim 15, wherein the rearranging of the quantized spectral parameter coefficients is carried out in a single split.

18. The apparatus of claim 15, wherein the rearranging of the quantized spectral parameter coefficient is carried out in a plurality of splits and an optimal code vector is selected based on the spectral distortion in each split.

19. A speech encoder for providing to a decoder a bitstream containing a first transmission signal indicative of code parameters, gain parameters and pitch parameters and a second transmission signal indicative of spectral representation parameters, wherein an excitation search module is used to provide the code parameters, the gain parameters and the pitch paramters, and a linear prediction analysis module is used to provide a plurality of spectral representation coefficients in a frequency domain, a plurality of predicted spectral representation values based on previously decoded output values, and a plurality of residual codebook vectors, said encoder comprising:

means, for obtaining a plurality of quantized spectral parameter coefficients from the respective predicted spectral parameter values and the residual codebook vectors for forming a quantized spectral representation having a plurality of elements indicative of the quantized spectral parameter coefficients, said obtaining means further providing a series of first signals indicative of the quantized spectral parameter coefficients;

means, responsive to the first signals, for rearranging the quantized spectral parameter coefficients in the frequency domain in an orderly fashion such that the elements in the representation are distributed in an ascending order, said rearranging means further providing a series of second signals indicative of the rearranged quantized spectral parameter coefficients; and means, responsive to the second signals, for obtaining the spectral distortion from the rearranged quantized spectral representation coefficients and the respective spectral representation coefficients for providing a series of third signals; and means, response to the third signals, for selecting a plurality of optimal code vectors representative of the spectral representation parameters based on the spectral distortion and for providing the second transmission signal indicative of optimal code vectors.

20. A mobile station capable of receiving and preprocessing input speech for providing a bitstream to at least one base station in a telecommunications network, wherein the bitstream contains a first transmission signal indicative of code parameters, gain parameters and pitch parameters, and a second transmission signal indicative of spectral representation parameters, wherein an excitation search module is used to provide the first transmission signal from the preprocessed input signal, and a linear prediction module is used to provide, based on the preprocessed input signal, a linear prediction module is used to provide a plurality of spectral representation coefficients in a frequency domain, a pluraltiy of predicted spectral representation values based on previously decoded output values, and a plurality of residual codebook vectors, said mobile station comprising:

means, for obtaining a plurality of quantized spectral parameter coefficients from the respective predicted spectral parameter values and the residual codebook vectors for forming a quantized spectral representation having a plurality of elements indicative of the quantized spectral parameter coefficients, said obtaining means further providing a series of first signals indicative of the quantized spectral parameter coefficients;

means, responsive to the first signals, for rearranging the quantized spectral parameter coefficients in the frequency domain in an orderly fashion such that the elements in the representation are distributed in an ascending order, said rearranging means further providing a series of second signals indicative of the rearranged quantized spectral parameter coefficients; and means, responsive to the second signals, for obtaining the spectral distortion from the rearranged quantized spectral representation coefficients and the respective spectral representation coefficients for providing a series of third signals indicative of spectral distortion;

means, responsive to the third signals, for selecting a plurality of optimal code vectors representative of spectral representation parameters for providing the second transmission signal indicative of the optimal code vectors.

* * * * *